US007836872B2

(12) United States Patent
Tseng

(10) Patent No.: US 7,836,872 B2
(45) Date of Patent: Nov. 23, 2010

(54) PNEUMATIC TOY GUN

(76) Inventor: Shu-Mei Tseng, No.5, Alley 2, Lane 333, Yung Ho Road, Chung Ho City, Taipei County 235 (TW)

( * ) Notice: Subject to any disclaimer, the term of this patent is extended or adjusted under 35 U.S.C. 154(b) by 189 days.

(21) Appl. No.: 12/270,935

(22) Filed: Nov. 14, 2008

(65) Prior Publication Data

US 2010/0071680 A1 Mar. 25, 2010

(30) Foreign Application Priority Data

Sep. 19, 2008 (TW) ..... 97217054 U

(51) Int. Cl.
*F41B 11/00* (2006.01)

(52) U.S. Cl. ..... 124/72; 124/31; 124/39; 124/80; 124/69

(58) Field of Classification Search ..... 124/31, 124/39, 69–77, 80
See application file for complete search history.

(56) References Cited

U.S. PATENT DOCUMENTS 5,257,614 A * 11/1993 Sullivan ..... 124/73
5,634,456 A * 6/1997 Perrone ..... 124/76
5,771,875 A * 6/1998 Sullivan ..... 124/72
6,766,795 B1 * 7/2004 Sullivan ..... 124/56
2006/0124118 A1 * 6/2006 Dobbins ..... 124/77
2007/0028909 A1 * 2/2007 Wood ..... 124/73

* cited by examiner

*Primary Examiner*—Troy Chambers
(74) *Attorney, Agent, or Firm*—McGinn IP Law Group, PLLC

(57) ABSTRACT

A pneumatic toy gun with a hammer assembly disposed inside a barrel is provided. The hammer assembly includes a first hammer and a second hammer, wherein the first hammer is disposed in front of the second hammer and the second hammer includes a notch. A first elastic element pushes the rear end of the first hammer and a second elastic element pushes the rear end of the second hammer. A first tackling block is disposed below the hammer assembly and rotatable around the pivot. The rear end of the first tackling block is stuck into the notch of the second hammer. A second tackling block is disposed adjacent to the first tackling block and includes a trough allowing the pivot to be disposed in. The rear end of the second tackling block is stuck into the notch of the second hammer. A third elastic element pushes the underneath of the rear half portion of the first tackling block. A fourth elastic element pushes the underneath of the rear half portion of the second tackling block. A rotor is disposed in front of the first tackling block. A switch includes a hook and a flange. The switch can be changed between a mode of repeater and a mode of single-shoot.

4 Claims, 13 Drawing Sheets

151

PNEUMATIC TOY GUN

BACKGROUND OF THE INVENTION

1. Field of the Invention

The present invention relates to a toy gun, especially to a pneumatic toy gun.

2. Description of the Prior Art

These days many people are very busy in their work. Leisure activities become very important for people to unwind and recharge so that they can face more challenges in the work. Leisure activities are very diversified, and many choices are available to suit individual's tastes and preferences. For instance, outdoor excursion, seeing movies, shopping and the like can help people to reduce tension. Some people prefer more exciting activities to release the internal pressure, such as thrilling games in theme parks, glider riding, bungee jumping or the like. In recent years a new type of game has been introduced, namely "Survival game". In the game players have to equip with comprehensive outfits to prevent accidents. Each person also is provided with a pneumatic toy gun and a plurality of paintballs. The paintball is a capsule containing pigments. This game is quite popular, not only because it is exciting, but also mainly the toy gun used in the game almost like a real one in terms of shooting accuracy, shooting range, look and weight. Hence it gives people thrill like being plunged in a real battlefield.

Most of the pneumatic toy guns now available in the market is allowing user to switch between the mode of repeater and single-shoot. The mode of single-shoot means that only one paintball was shot in every single trigger. The mode of repeater means a plurality of paintballs was fired successively in only one trigger. Until this moment, the pneumatic toy gun, with function of the repeater, includes an electromagnetic valve, a circuit board, and a battery. The electromagnetic valve is used to push the tackling block in order to release the hammer assembly, the circuit board controls the operation of electromagnetic valve, and the battery provides the energy source to electromagnetic valve.

However, the electromagnetic valve, the circuit board, and the battery are space-consumption elements. Besides, the player will feel annoyed if the battery is run out in the fight.

Therefore, how to achieve the function of repeater without any electrical apparatus disposed in pneumatic toy gun is an issue remained to be resolved in the industry.

SUMMARY OF THE INVENTION

The primary object of the invention is to provide a pneumatic toy gun equipped with the function of repeater without the electromagnetic valve, the circuit board and the battery.

To achieve the foregoing and other objects, a pneumatic toy gun is provided. The pneumatic toy gun includes a barrel, a hammer assembly, a first elastic element, a second elastic element, a pivot, a first tackling block, a second tackling block, a third elastic element, a fourth elastic element, a rotor, a switch, and a trigger. The hammer assembly is located inside the barrel and comprises a first hammer and a second hammer. The first hammer is disposed in front of the second hammer and the second hammer comprises a notch. The first elastic element pushes the rear end of the first hammer and the second elastic element pushes the rear end of the second hammer. Moreover, the first tackling block is disposed below the hammer assembly and is rotatable around the pivot. The rear end of the first tackling block is stuck into the notch of the second hammer. The second tackling block is disposed adjacent to the first tackling block and comprises a trough allowing the pivot to be disposed in. The rear end of the second tackling block is stuck into the notch of the second hammer. The third elastic element pushes the underneath of the rear half portion of the first tackling block. The fourth elastic element pushes the underneath of the rear half portion of the second tackling block. Furthermore, the rotor is disposed in front of the first tackling block. The switch that can be changed between a mode of repeater and a mode of single-shoot comprises a hook and a flange. The first tackling block is abutted against the flange and departed from the notch when the switch is in the mode of single-shoot. When the switch is in the mode of repeater, the hook resists the second tackling block and prevents the trough of the second tackling block from being slipped with respect to the pivot. When the trigger is activated, the top end of the trigger can drive the second tackling block and then depart the second tackling block from the notch. When the first hammer is at the activating position, the rotor is touched and rotated by the first hammer so as to let the first tackling block be driven by the rotor and departed from the notch.

In the aforementioned pneumatic toy gun, the second elastic element, the third elastic element, and the fourth elastic element are springs. The first elastic element penetrates the second hammer and further includes a tube and a push bar. The spring is disposed inside the tube. The rear end of the push bar is abutted against the spring and the front end of the push bar is fixed on the first hammer.

Because the present pneumatic toy gun can achieve the function of repeater without any electrical apparatus such as the electromagnetic valve, the circuit board, and the battery, it needs not to save any space for the electrical apparatus. Furthermore, the situation that the electric power of the battery is run out in the fight will never happen if using the present pneumatic toy gun.

The objects, features and advantages of the present invention will be apparent understood from the following detailed descriptions of the preferred aspect of the invention in conjunction with reference to the following drawings.

DESCRIPTION OF THE PREFERRED EMBODIMENT

Figure 1:
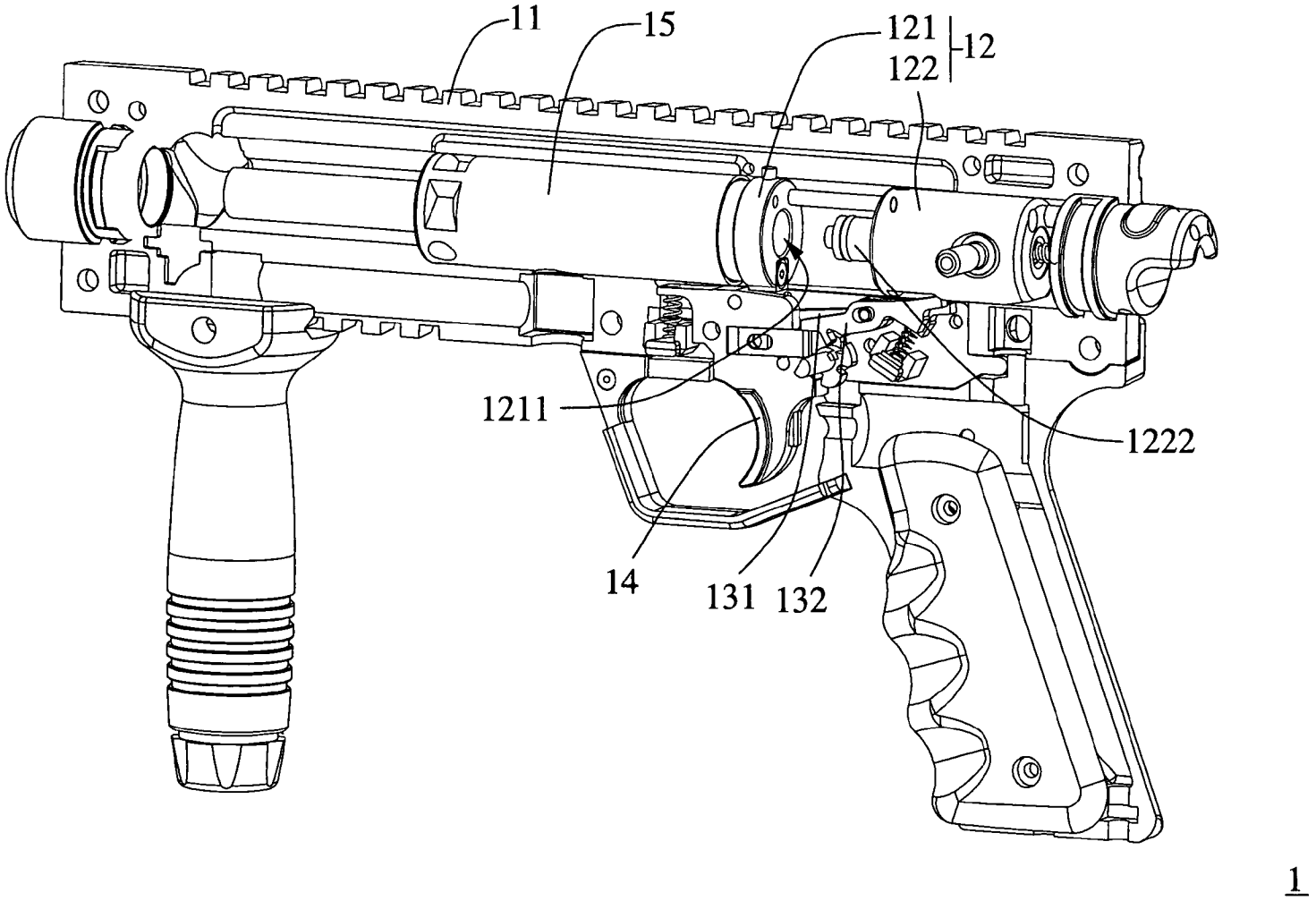
FIG. 1 is an inner perspective view of pneumatic toy gun of an embodiment in the invention.

Please refer to FIG. 1. FIG. 1 is an inner perspective view of pneumatic toy gun of an embodiment in the invention. The pneumatic toy gun 1 includes a barrel 11, a hammer assembly 12, a first tackling block 131, a second tackling block 132, a trigger 14, and a gas cylinder 15. The hammer assembly 12 and gas cylinder 15 are disposed inside the barrel 11. The hammer assembly 12 includes a first hammer 121 and a second hammer 122. The first hammer 121 is disposed in front of the second hammer 122. There is a cavity 1211 located in the center of the first hammer 121. An actuator 1222 is disposed at the front end of the second hammer 122. The radius of the actuator 1222 is less than that of the cavity 1211, so the actuator 1222 can penetrates the cavity 1211. In addition, the first tackling block 131 and the second tackling block 132 are both disposed under the hammer assembly 12 and adjacent to each other. The gas cylinder 15 includes a valve (not shown) inside.

Figure 2A:
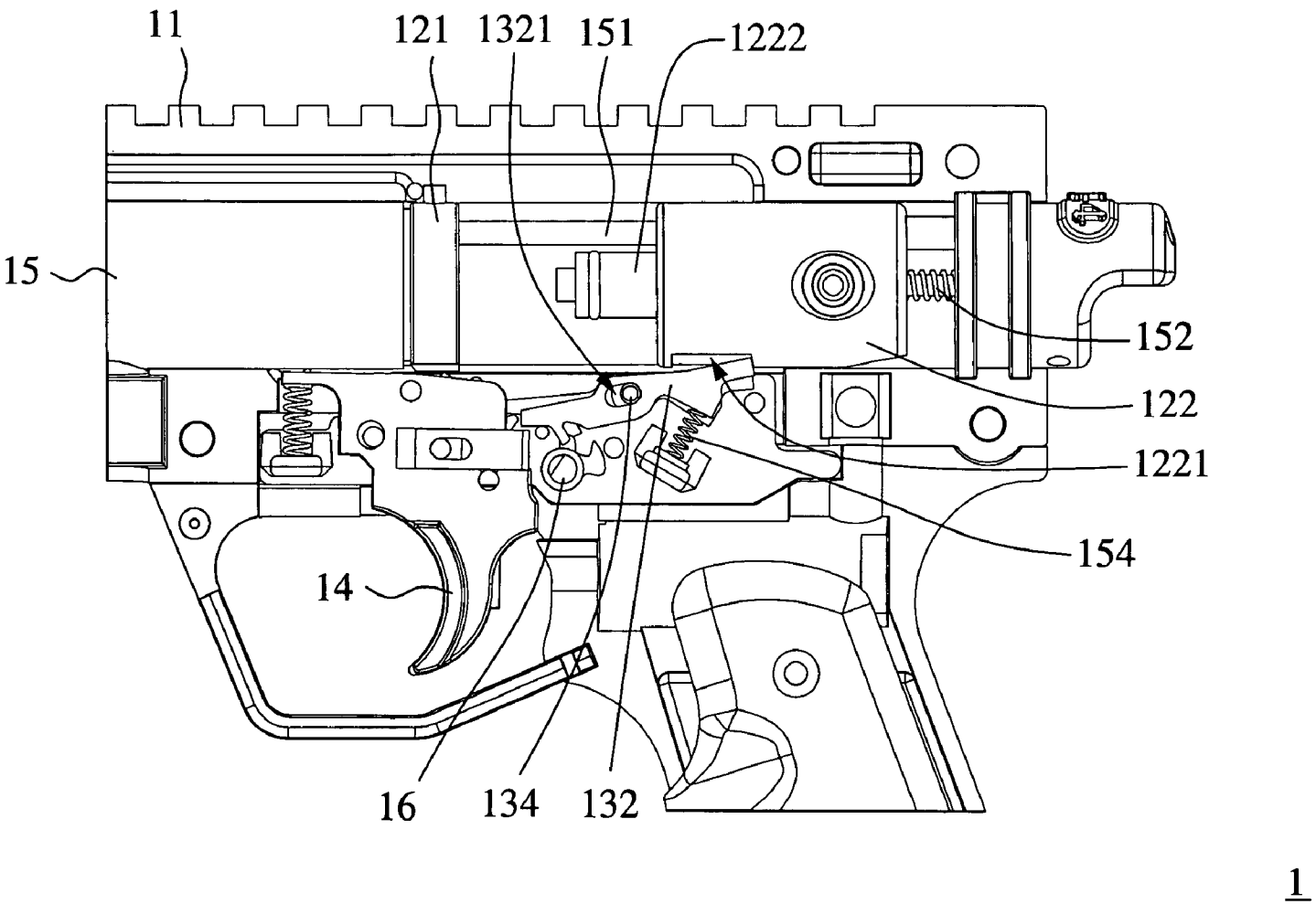
FIG. 2A is an inner front-view of the present pneumatic toy gun.

Please refer to FIG. 2A. FIG. 2A is an inner front-view of the present pneumatic toy gun. The second tackling block 132 includes a trough 1321. A pivot 134 is disposed in the trough 1321. Besides, a notch 1221 is disposed in the bottom of the second hammer 122. The rear end of the second tackling block 132 is stuck into said notch 1221. The pneumatic toy gun 1 further includes a first elastic element 151 and a second elastic element 152. The rear end of the first hammer 121 is pushed by the first elastic element 151. The second elastic element 152 is a spring. The second elastic element 152 pushes the rear end of the second hammer 122. Moreover, the pneumatic toy gun 1 includes a fourth elastic element 154 and the fourth elastic element 154 is a spring. The underneath of the rear half portion of the second hammer 122 is pushed by the fourth elastic element 154.

Figure 2B:
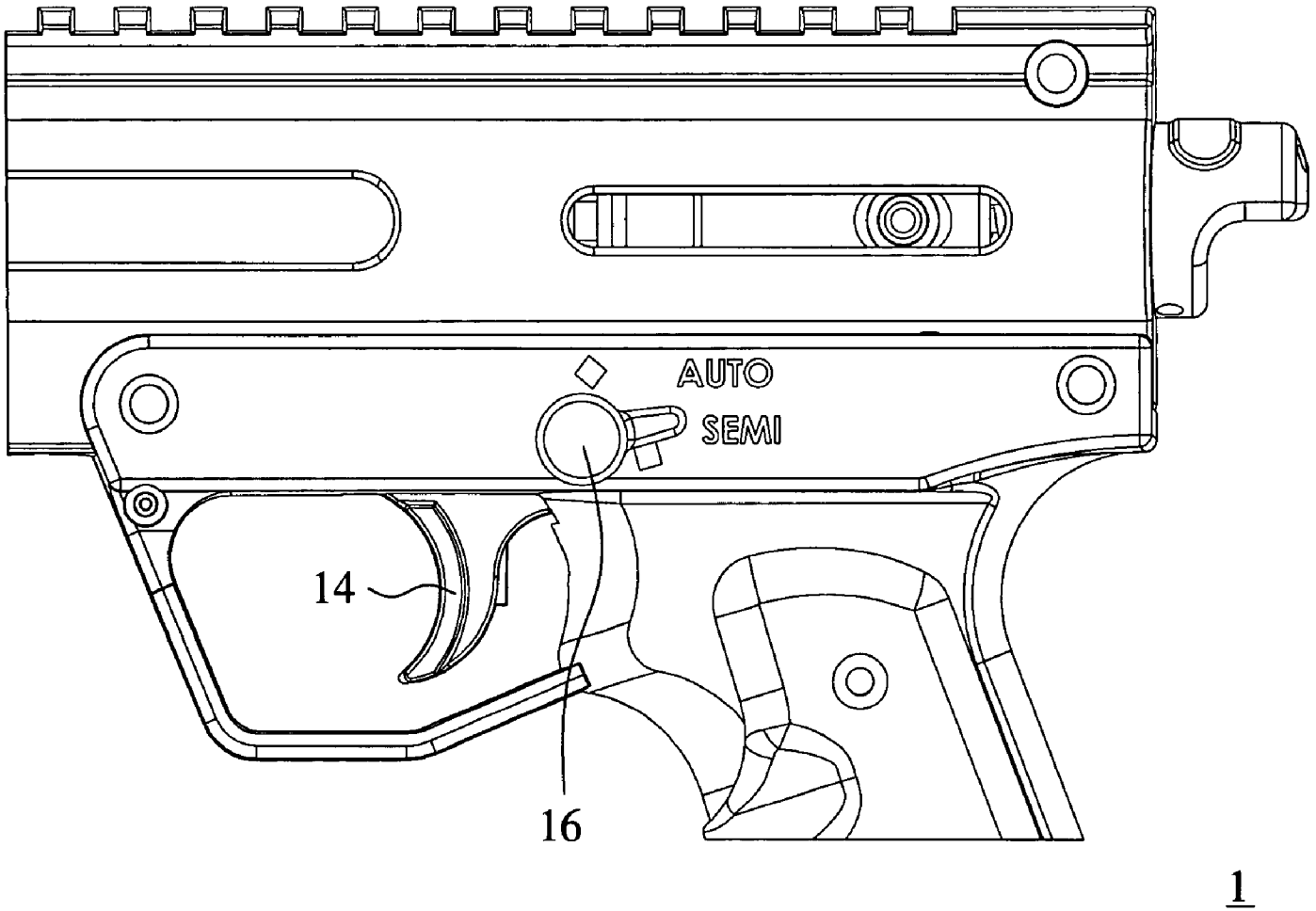
FIG. 2B is a perspective view of the pneumatic toy gun.
Figure 2C:
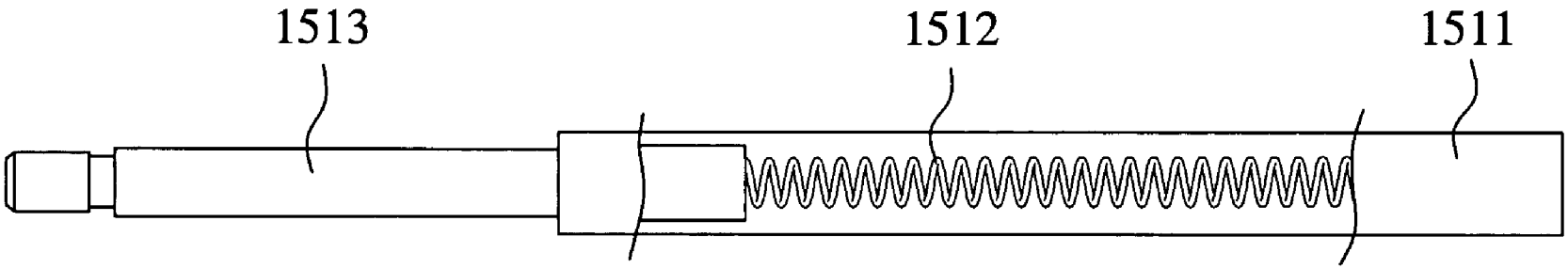
FIG. 2C is an inner perspective view of the first elastic element.

Referring to FIG. 2C, the first elastic element 151 includes a push bar 1513 and a tube 1511. A spring 1512 is disposed in the tube 1511. The rear end of the push bar 1513 is abutted against the spring 1512. When the push bar 1513 is shifted backward to compress the spring 1512, the push bar 1513 will be pushed by the spring 1512.

Please refer to FIGS. 2A and 2B. FIG. 2B is a perspective view of the pneumatic toy gun. The pneumatic toy gun 1 includes a switch 16. The switch 16 can be changed between the mode of repeater (shown as "AUTO" in FIG. 2B) and the mode of single-shoot (shown as "SEMI" in FIG. 2B). In FIGS. 2A and 2B, the switch 16 is in the mode of single-shoot.

Figure 3A:
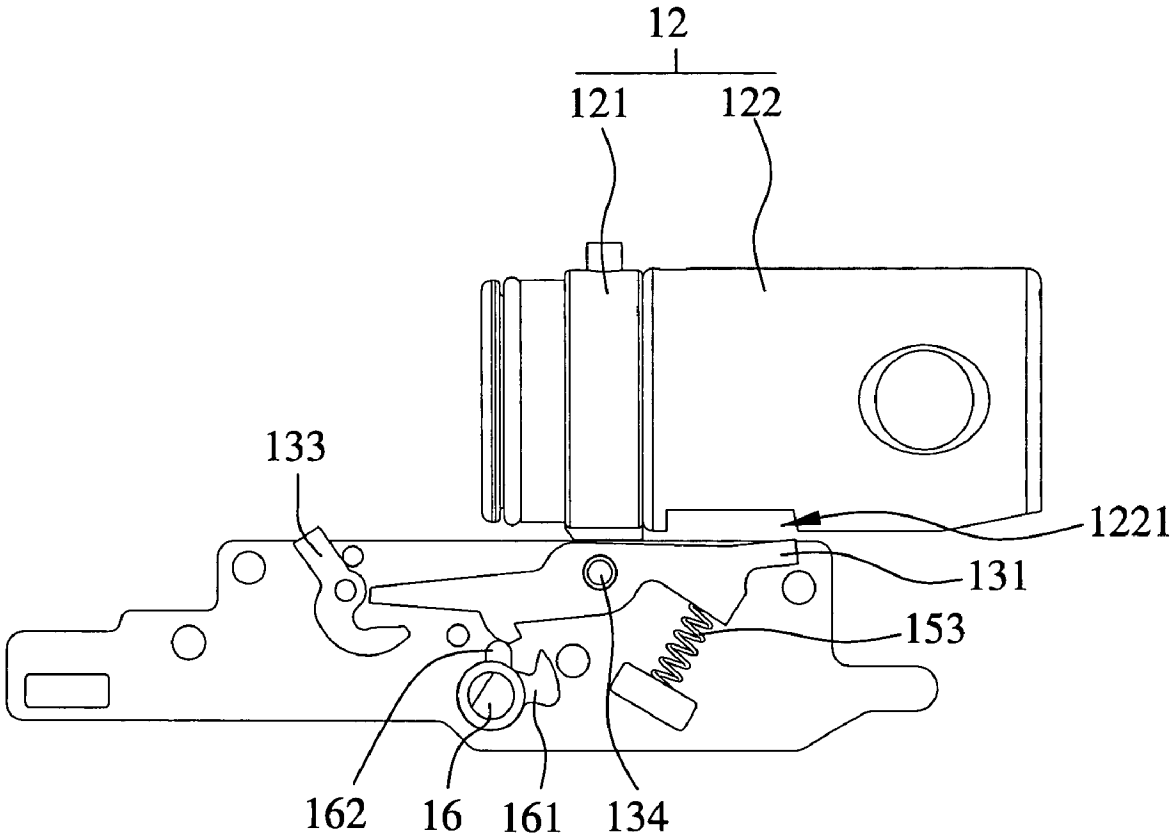
FIG. 3A depicts the corresponding position of the first tackling block, switch and the second hammer in the mode of single-shoot.
Figure 3B:
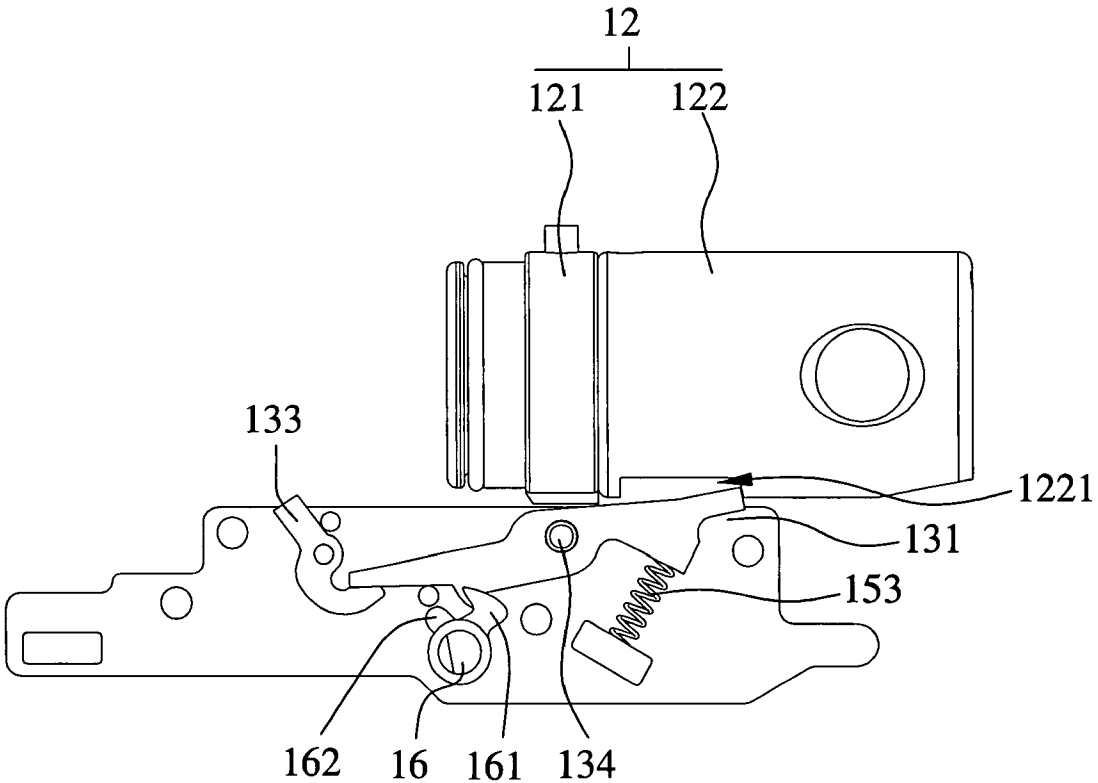
FIG. 3B depicts the corresponding position of the first tackling block, switch and the second hammer in the mode of repeater.

Please refer to FIG. 3A and FIG. 3B. FIG. 3A depicts the corresponding position of the first tackling block, switch and the second hammer in the mode of single-shoot. FIG. 3B depicts the corresponding position of the first tackling block, switch and the second hammer in the mode of repeater. In FIG. 3A, it is shown that the switch 16 includes a hook 161 and a flange 162. The first tackling block 131 is rotatable around the pivot 134. Moreover, a rotor 133 is disposed in front of the first tackling block 131. A pushing force is applied from the third elastic element 153 to the underneath of the rear half portion of the first tackling block 131. The third elastic element 153 is a spring.

The FIG. 3A shows that the flange 162 is abutted against the first tackling block 131 when the switch 16 is in the mode of single-shoot. Please refer to FIG. 3B. The flange 162 is departed from the first tackling block 131 when the switch 16 is in the mode of repeater. And then the front end of the first tackling block 131 is abutted against the rotor 133 so as to drive the rear end of the first tackling block 131 being stuck into the notch 1221 of the second hammer 122.

Figure 4A:
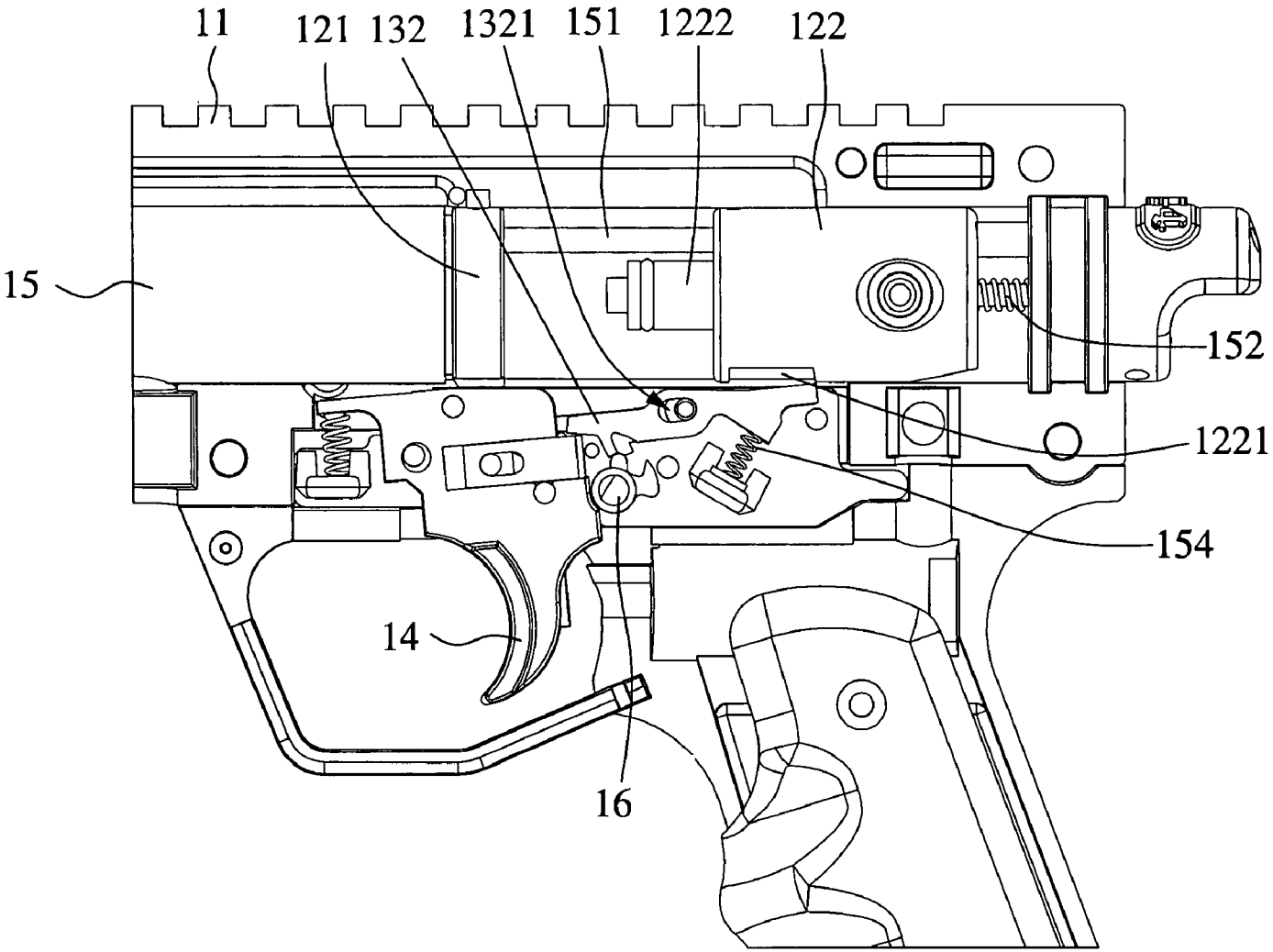
FIG. 4A and FIG. 4B depict the operation process inside the pneumatic toy gun in the mode of single-shoot.
Figure 4B:
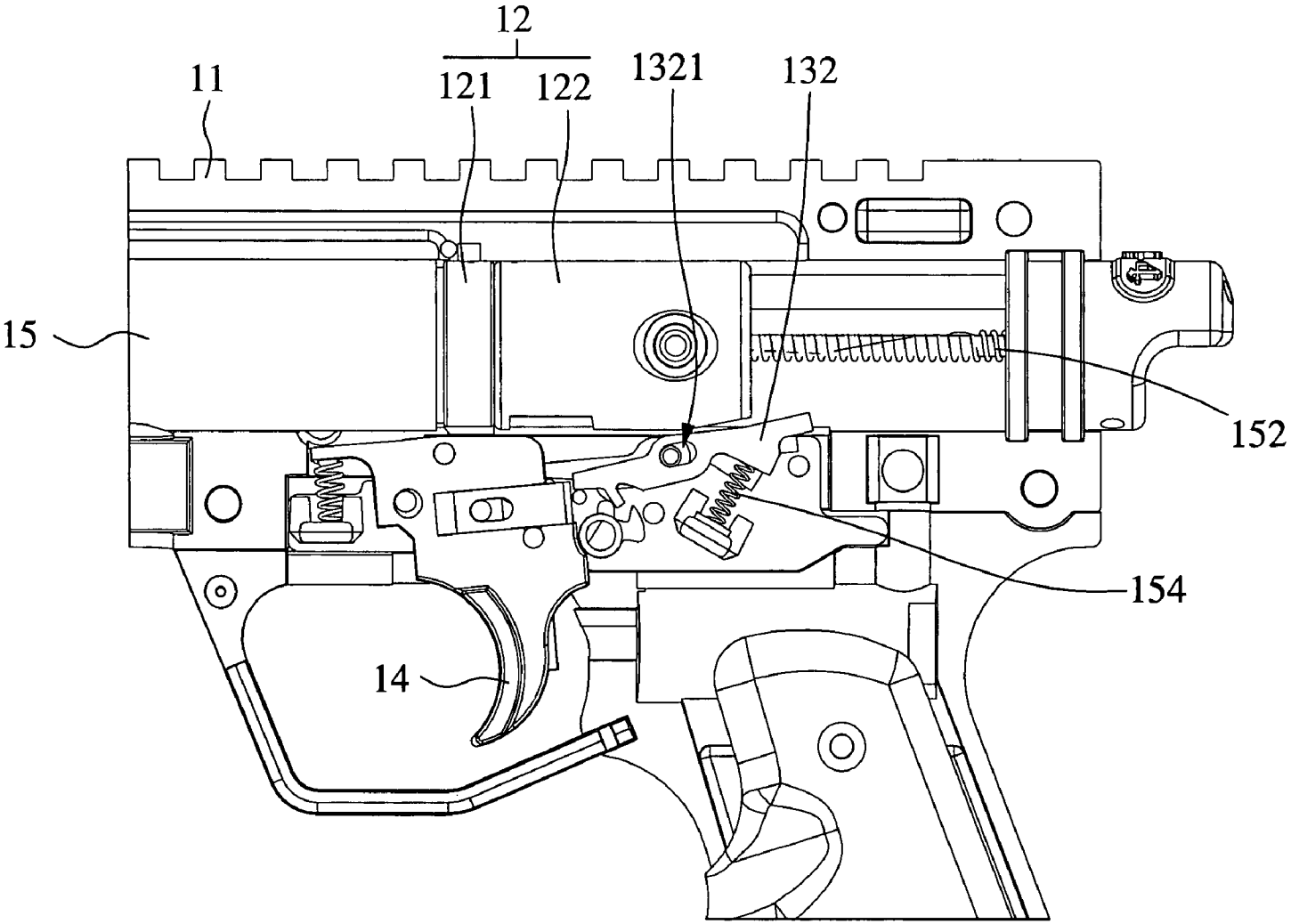

Please refer to FIG. 2A, FIG. 4A, and FIG. 4B. FIG. 4A and FIG. 4B show the operation process inside the pneumatic toy gun in the mode of single-shoot. In FIG. 2A, due to the push from the first elastic element 151, the first hammer 121 is shifted forward until being contacted with the gas cylinder 15, i.e. the activating position. In this moment, because the rear end of the second tackling block 132 is stuck into the notch 1221, the second hammer 122 will be halted in the pre-activating position, regardless of the pushing force applied from the second elastic element 152 to the rear end of the second hammer 122.

Please refer to FIG. 4A, when the trigger 14 is activated, the second tackling block 132 will be pushed by the top of the trigger 14 and departed from notch 1221. Please refer to FIG. 4B, it shows that the second hammer 122 is pushed forward by the second elastic element 152 until it reaches the activating position. In the meantime, the second tackling block 132 is pushed to rear up side by the fourth elastic element 154 and departed from the trigger 14. When the second hammer 122 is at the activating position, the actuator 1222 of the second hammer 122 (shown in FIG. 4A) opens the valve in the gas cylinder 15, and then the compressed gas is flowed into the gas cylinder 15. The compressed gas that flows into the gas cylinder 15 is divided into two portions. One portion flows forward to eject the projectile and another portion flows backward to push the hammer assembly 12 to the pre-activating position.

Figure 5A:
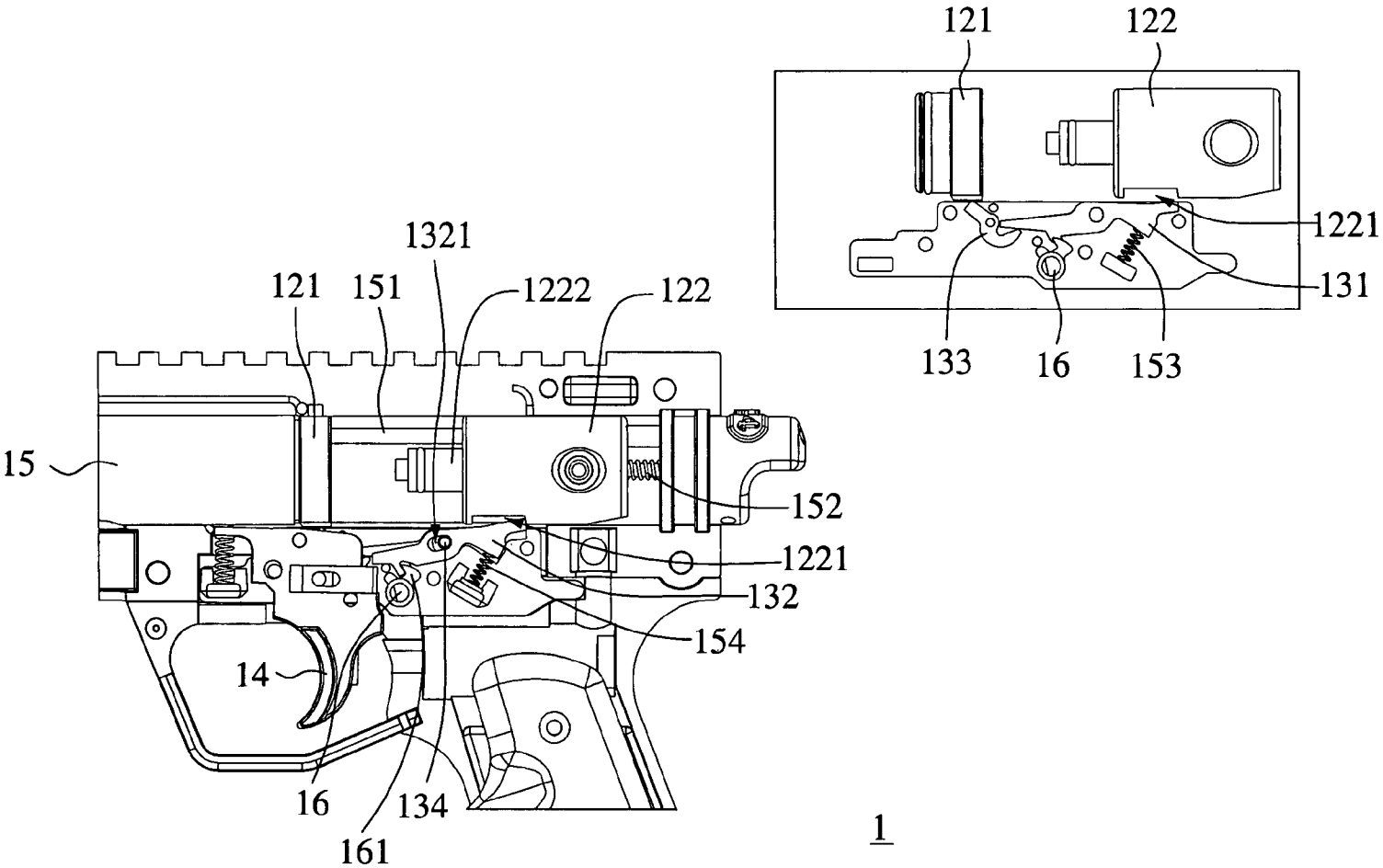
FIG. 5A~FIG. 5E depict the operation process inside the pneumatic toy gun in the mode of repeater.
Figure 5B:
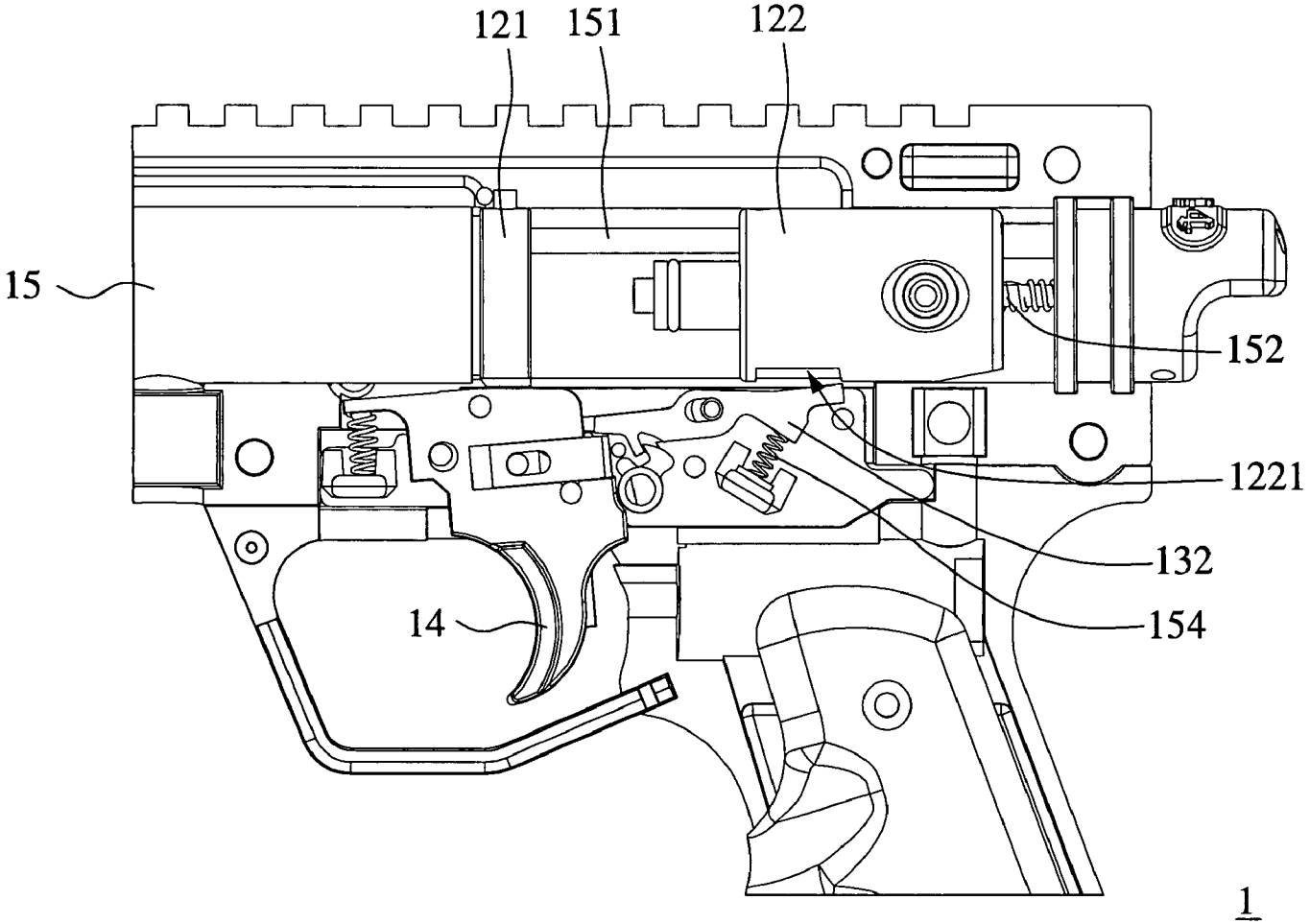
Figure 5C:
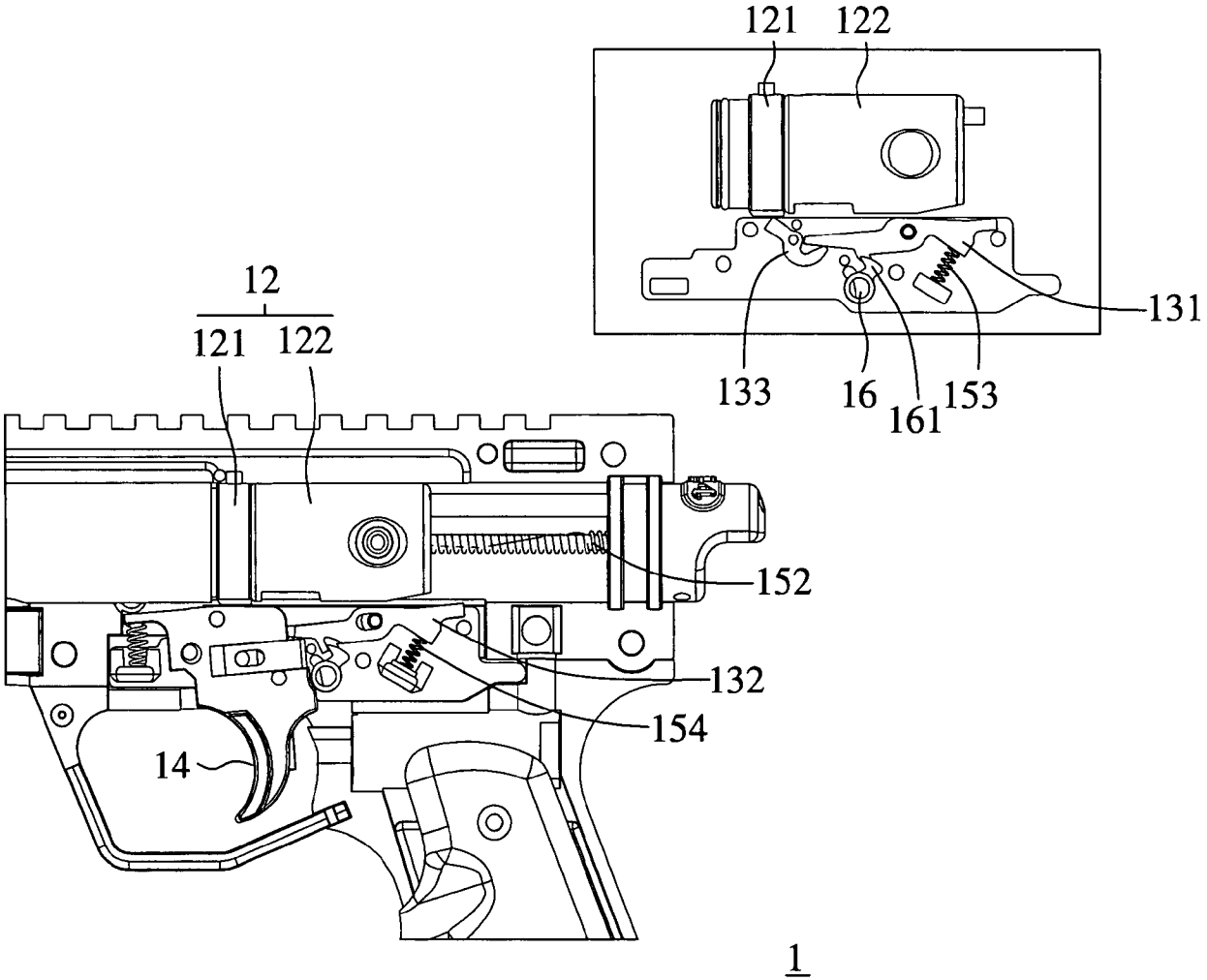
Figure 5D:
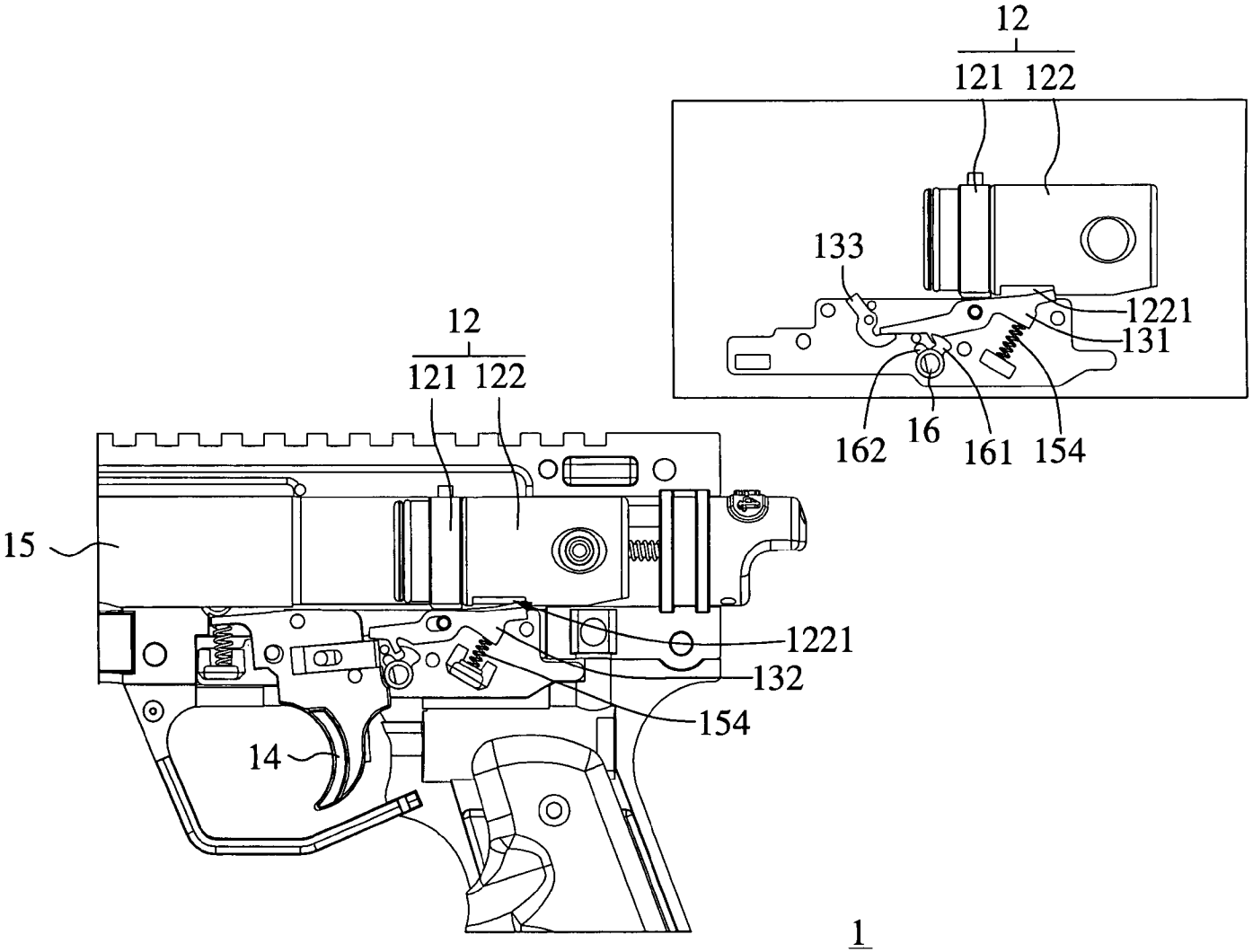

Please refer to FIG. 5A~FIG. 5E, which depict the operation process inside the pneumatic toy gun in the mode of repeater. FIG. 5A, FIG. 5C and FIG. 5D particularly emphasize the corresponding position of the first tackling block, switch and second hammer in up right corner of the diagram. Firstly referring to FIG. 5A, the hook 161 of said switch 16 is stuck into the second tackling block 132 to prevent the trough 1321 from being slipped with respect to the pivot 134 when the switch 16 is in the mode of repeater. Due to the pushing force from the first elastic element 151, the first hammer 121 is shifted forward to the activating position. Furthermore, although the pushing force is applied from the second elastic element 152 to the rear end of the second hammer 122, the second hammer 122 still be halted in the pre-activating position due to the rear end of the second tackling block 132 being stuck into the notch 1221. In FIG. 3B, it is shown that the rear end of the first tackling block 131 is disposed in the notch 1221 of the second hammer 122. When the first hammer 121 is at the activating position, the rotor 133 is contacted and rotated by the first hammer 121. Afterward, the first tackling block 131 is pushed by the front end of the rotor 133 and departed from the notch 1222.

Please refer to FIG. 5B, when the trigger 14 is activated, the second tackling block 132 will be pushed by the top of said trigger 14 and departed from the notch 1221. In FIG. 5C, it is shown that the second hammer 122 is pushed forward by the second elastic element 152 to the activating position. In this meantime, due to the hook 161 of switch 16 being stuck into the second tackling block 132, the second tackling block 132 won't be pushed to rear up side by the fourth elastic element 154. Thus, the second tackling block 132 is kept contacted with the trigger 14. When the second hammer 122 is at the activating position, the actuator 1222 (shown in FIG. 5A) of the second hammer 122 opens the valve of gas cylinder 15, and then the compressed gas is flowed into the gas cylinder 15. The compressed gas that flows into the gas cylinder 15 is divided into two portions. One portion flows forward to eject the projectile and another portion flows backward to push the hammer assembly 12 to pre-activating position (shown in FIG. 5D).

In addition, please refer to FIG. 5D. When the hammer assembly 12 is pushed to the pre-activating position, the first hammer 121 will be departed from the rotor 133. Thus, one end of rotor 133 contacted with the first tackling block 131 will be lowered. Then the first tackling block 131 is rotated counter-clockwise and the rear end of the first tackling block 131 is stuck into the notch 1221. Afterward, the gas cylinder 15 is shut again and the first hammer 121 is pushed to the activating position shown in FIG. 5B. In this moment, the user only keep on pressing the trigger 14, the components of pneumatic toy gun 1 will repeat the operating process successively (shown in FIGS. 5B to 5D). Then, the pneumatic toy gun 1 can achieve the function of repeater.

Figure 5E:
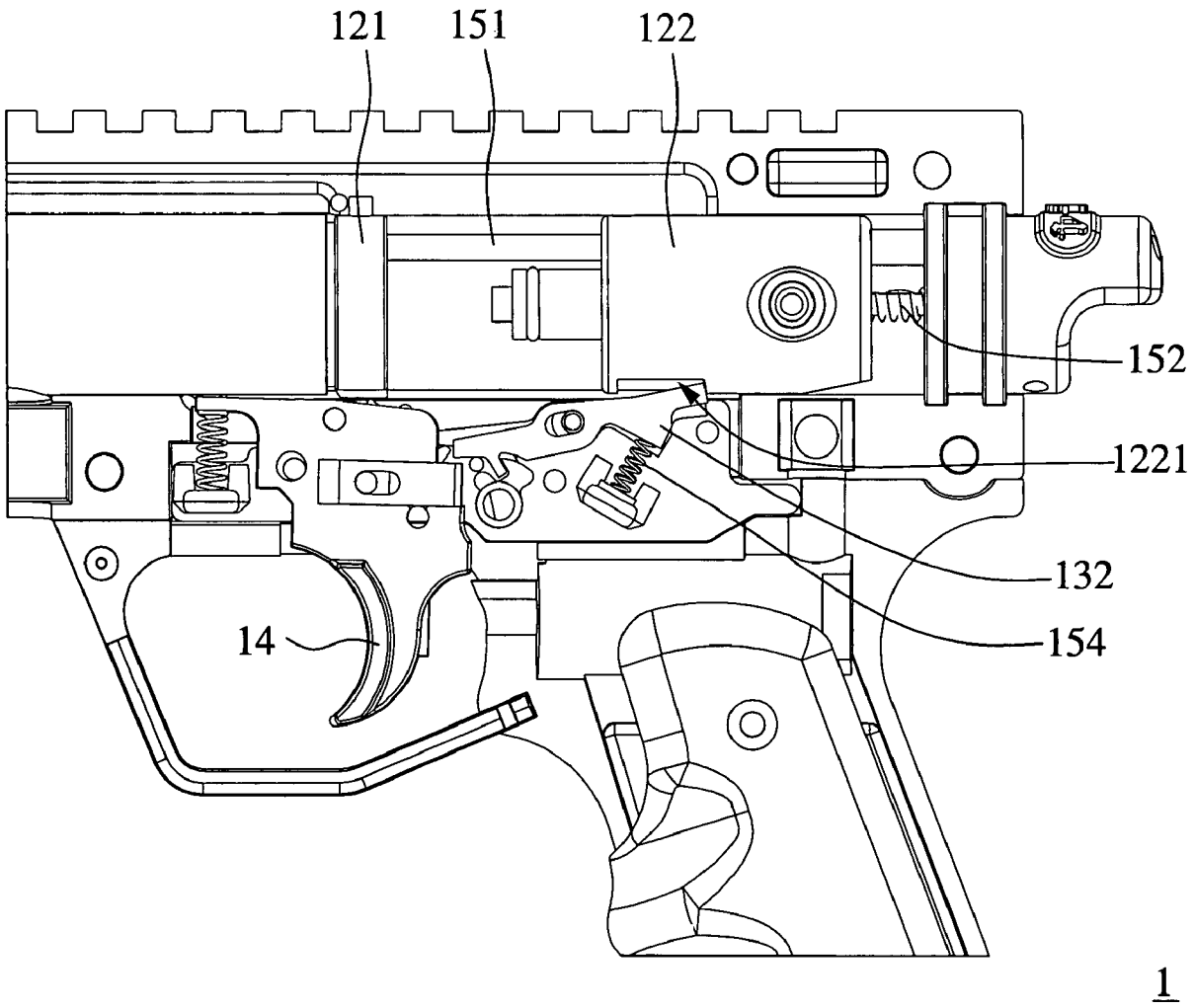

Finally, please refer to FIG. 5E. When the pressed trigger 14 is released, the second tackling block 132 will be pushed counter-clockwise by the fourth elastic element 154. Consequently, the rear end of the second tackling block 132 is stuck into the notch 1221 and the second hammer 122 is halted in the pre-activating position.

As described above, the pneumatic toy gun in the present invention doesn't need any electrical apparatus, such as electromagnetic valve, circuit board, and battery, to achieve the function of repeater. Thus, it needs not to save any space for the electrical apparatus. Furthermore, if using the present pneumatic toy gun, the situation that the electric power of the battery is run out in the fight will never happen.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

I claim:

1. A pneumatic toy gun, comprising:

a barrel;

a hammer assembly located inside the barrel and comprising a first hammer and a second hammer, wherein the first hammer is disposed in front of the second hammer and the second hammer comprises a notch;

a first elastic element pushing the rear end of the first hammer;

a second elastic element pushing the rear end of the second hammer;

a pivot;

a first tackling block disposed below the hammer assembly and being rotatable around the pivot; the rear end of the first tackling block being stuck into the notch of the second hammer;

a second tackling block disposed adjacent to the first tackling block and comprising a trough allowing the pivot to be disposed in, the rear end of the second tackling block stuck into the notch of the second hammer;

a third elastic element pushing the underneath of the rear half portion of the first tackling block;

a fourth elastic element pushing the underneath of the rear half portion of the second tackling block;

a rotor disposed in front of the first tackling block;

a switch, being able to be changed between a mode of repeater and a mode of single-shoot, comprising a hook and a flange, wherein the first tackling block is abutted against the flange and departed from the notch when the switch is in the mode of single-shoot, the hook resists the second tackling block and prevents the trough of the second tackling block from being slipped with respect to the pivot when the switch is in the mode of repeater; and a trigger whose top end can drive the second tackling block and then depart the second tackling block from the notch when the trigger is activated;

when the first hammer is at the activating position, the rotor is touched and rotated by the first hammer so as to let the first tackling block be driven by the rotor and departed from the notch.

2. The pneumatic toy gun of claim 1, wherein the third elastic element and the fourth elastic element are both springs.

3. The pneumatic toy gun of claim 1, wherein the second elastic element is a spring.

4. The pneumatic toy gun of claim 1, wherein the first elastic element penetrates the second hammer and further comprises:

a tube in which a spring is disposed; and a push par whose rear end is abutted against the spring and the front end of the push bar is fixed on the first hammer.

* * * * *